United States Patent [19]

Miyazaki

[11] Patent Number: 4,552,080

[45] Date of Patent: Nov. 12, 1985

[54] CLOTH CUTTING DEVICE IN BUTTON-HOLE SEWING MACHINE

[75] Inventor: Hiroshi Miyazaki, Aichi, Japan

[73] Assignee: Mitsubishi Denki Kabushiki Kaisha, Tokyo, Japan

[21] Appl. No.: 490,893

[22] Filed: May 2, 1983

[30] Foreign Application Priority Data

Apr. 30, 1982 [JP] Japan ..... 57-72937

[51] Int. Cl.[4] ..... D05B 3/06

[52] U.S. Cl. ..... 112/68; 112/130; 112/301

[58] Field of Search ..... 112/68, 67, 65, 276, 112/301, 130

[56] References Cited

U.S. PATENT DOCUMENTS

| | | | |
|---|---|---|---|
| 1,846,426 | 2/1932 | Kiewicz | 112/68 |
| 2,555,095 | 5/1951 | Reece | 112/68 X |
| 3,578,770 | 5/1971 | Van Hazendonk | 112/301 X |
| 3,667,410 | 6/1972 | Bianchi | 112/276 X |

*Primary Examiner*—H. Hampton Hunter

*Attorney, Agent, or Firm*—Sughrue, Mion, Zinn Macpeak & Seas

[57] ABSTRACT

In a button-hole sewing machine where a piece of cloth is cut from a button hole before or after the sewing operation, a moveable knife cooperating with a stationary knife is driven through a mechanical linkage by an air drive unit and the operating pressure and speed of the moveable knife are changed by adjusting the device associated with the air drive unit.

6 Claims, 4 Drawing Figures

CLOTH CUTTING DEVICE IN BUTTON-HOLE SEWING MACHINE

BACKGROUND OF THE INVENTION

1. Field of the Invention

The present invention relates to a cloth cutting device in a button-hole sewing machine, and more particularly to a cloth cutting device for cutting a piece of cloth to make a button hole or the like before the button hole or the like is sewn.

2. Description of the Prior Art

A button-hole sewing machine for forming button holes such as eyelet holes is well known in the art. A sewing machine of this type is provided with a cloth cutting device which cuts a piece of cloth along the contour of a desired button hole before or after the button hole is sewn.

In such a conventional cloth cutting device, a moveable knife is mechanically driven by the utilization of the drive force of a main cam, so that a piece of cloth is cut by the cooperation of the moveable knife with a stationary knife. In a conventional device the moveable knife is driven by a mechanical drive source, namely, the main cam as described above. Therefore, the stroke of the moveable knife can be adjusted, but the operating speed or pressure of the moveable knife cannot be adjusted.

In other words, the operating speed of the moveable knife is determined indiscriminately from the sewing speed of the sewing machine, and the operating pressure of the moveable knife is defined by the operating speed. Accordingly, the operating speed and the operating pressure cannot be adjusted. Therefore, components, including these knives may be broken, and sometimes the piece of cloth cannot be cut very well.

SUMMARY OF THE INVENTION

In view of the foregoing, an object of the present invention is to provide a cloth cutting device for a button-hole sewing machine in which the stroke, operating speed and operating pressure of the moveable knife can be adjusted.

The foregoing objects and other objects of the invention have been achieved by the provision of a cloth cutting device for a button-hole sewing machine in which a piece of cloth is cut along the contour of a button hole or the like before or after the latter is sewn. The cutting device is comprised of a link mechanism for driving a moveable knife relative to a stationary knife and an air drive unit for driving the link mechanism so that the piece of cloth is cut by the cooperation of the two knives.

The nature, principle and utility of the invention will become more apparent from the following detailed description when read in conjunction with the accompanying drawings.

DETAILED DESCRIPTION OF THE PREFERRED EMBODIMENT

One preferred embodiment of this invention will be described with reference to the accompanying drawings.

Figure 1:
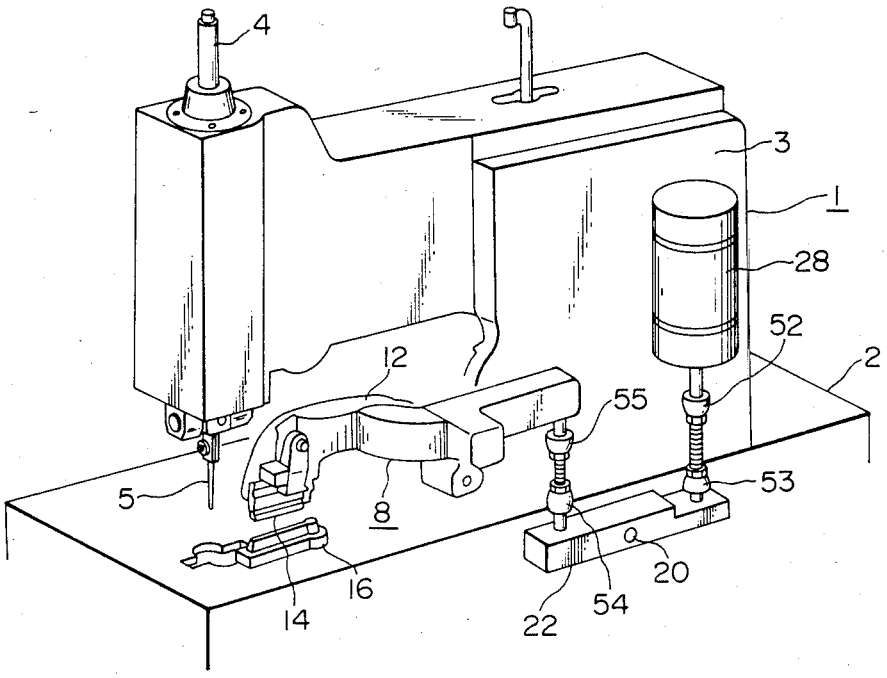
FIG. 1 is a schematic perspective view of a button-hole sewing machine equipped with a cloth cutting device according to the present invention.

In FIG. 1 the button-hole sewing machine includes a botton-hole sewing machine body 1, the bed 2 of the machine body 1, an arm 3, a needle bar 4, a sewing needle 5 which is fixedly secured to the lower end of the needle bar, the sewing needle 5 being moved up and down by the needle bar and a cloth cutting device 8.

Figure 2:
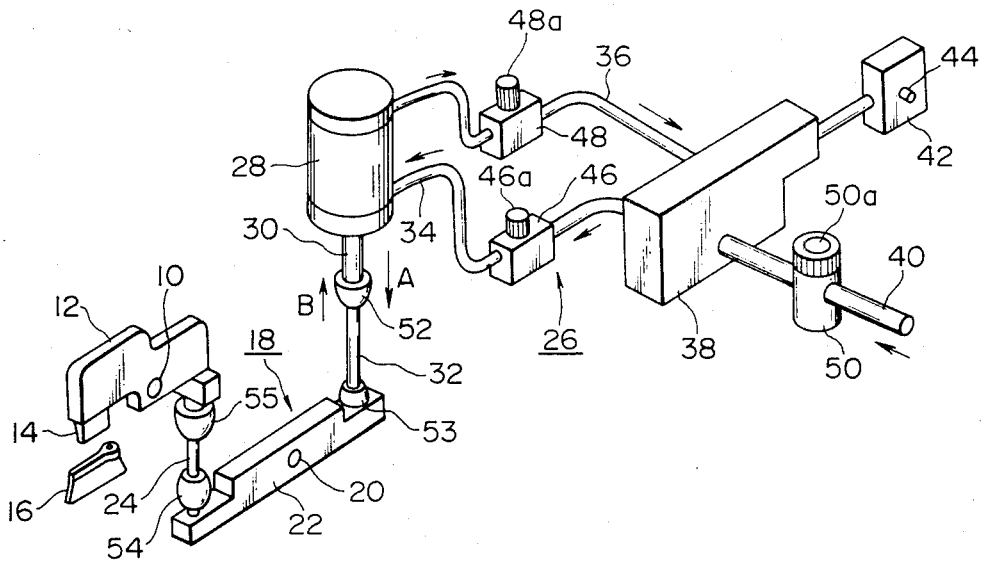
FIG. 2 is a further schematic view showing the arrangement of the cloth cutting device of the invention.

In the cloth cutting device according to the present invention as shown in FIG. 2 a moveable knife 14 is detachably mounted on the end of a hammer lever 12. The hammer lever 12 is rotatably mounted on a shaft (not shown) which is inserted into a hole 10 and serves as a fulcrum. A stationary knife 16 is provided in such a manner that it is in alignment with the moveable knife 14. A piece of cloth is cut along the configuration of a button hole by the cooperation of the knives 14 and 16. In order to cause the moveable knife 14 to cooperate with the stationary knife 16, a mechanical linkage 18 is provided. The linkage is composed of lever arm 22 which is rotatably mounted on a shaft (not shown) which is inserted into the hole 20 of the arm 22. One end portion of the lever arm 22 is rockably coupled by means of a pushing rod 24 to one end portion of the above-described hammer lever 12.

One of the specific features of the invention resides in the provision of an air drive unit for driving the mechanical linkage, that is, the air drive unit drives the moveable knife.

The air drive unit 26 has an air drive cylinder 28. The shaft 30 of the air cylinder 28 and the other end portion of the lever arm 22 are rockably coupled to each other through a push rod 32.

An air supply pipe 34 and an air exhaust pipe 36 are connected to the air cylinder 28, so that air from a compressor (not shown) is supplied to the air cylinder 28 through the air supply pipe 34 and the air in the cylinder 28 is removed through the air exhaust pipe 36.

The cloth cutting device of the invention has a solenoid valve 38 in order to supply air to the air cylinder 28 and to remove the air from the cylinder 28. When the solenoid valve 38 is energized, the air supplied through a pipe 40 from the compressor is supplied through the air supply pipe 34 to the air cylinder and when the solenoid valve 38 is de-energized, the air in the cylinder 28 is removed through the air exhaust pipe 36. The solenoid valve 38 is operated according to data which have been programmed in a control panel 42, including a microcomputer, that is, the solenoid valve 38 is energized and de-energized with desired timing. A moveable knife operation selecting switch 44 is provided on the control panel 42 so that the operation and non-operation of the hammer lever 12 can be freely selected.

In order to control the operating speed of the moveable knife 14, the air supply pipe 34 has a speed controller 46 therein and the air exhaust pipe 36 also has a speed controller 48 therein. The speed controllers 46 and 48 are, for instance, needle valves. The air supplying speed and the air exhausting speed can be controlled by operating the control knobs 46*a* and 48*a* of the speed controllers 46 and 48 respectively.

In order to control the operating pressure of the moveable knife 14, the pipe 40 has a pressure controller 50 at the middle. The presssure controller 50 is, for instance, a needle valve. The pressure of air supplied to the air cylinder 28, i.e., the operating pressure of the moveable knife 14 can be controlled by operating the control knob 50*a* of the pressure controller 50.

Further in FIG. 2, reference numerals 52 through 55 designate the various ball-type couplings in the mechanical linkage 18.

The operation of the cloth cutting device according to the present invention will be described. When it is desired to cut the cloth at a specific time the solenoid valve 38 is energized so that air is supplied from the air compressor through the pipes 40 and 34 into the air cylinder 28. As a result, the shaft 30 of the air cylinder 28 is moved in the direction of the arrow A, the lever drive arm 22 is turned clockwise, and the hammer lever 12 is turned counterclockwise, in FIG. 2. That is, the moveable knife 14 cooperates with the stationary knife 16, to cut the piece of cloth under pressure to thereby form a button hole having the desired configuration therein.

After the cutting operation, the solenoid valve 38 is de-energized, and the air is discharged from the air cylinder 28 through the pipe 36. Accordingly, the air cylinder shaft 30 is moved in the direction of the arrow B and the moveable knife 14 is returned to its original position.

Adjustment of the stroke of the moveable knife 14 can be achieved by controlling the period of energization of the solenoid valve 38. Therefore, the most suitable stroke can be selected for the thickness of the piece of cloth which is to be cut for a button hole.

The operating speed of the moveable knife 14 can be controlled by operating the control knobs 46*a* and 48*a* of the speed controllers 46 and 48. Therefore, the cloth cutting operation can be carried out at a desired speed.

The operating pressure of the moveable knife 14 can be adjusted by operating the control knob 50*a* of the pressure controller 50. Therefore, within the limit of the mechanical strength of components, including the knives 14 and 16, the most desirable cloth cutting pressure can be provided for the thickness of the piece of cloth to cut for the button hole.

As is clear from the above description, the cloth cutting device of the invention utilizes the air drive unit 26 for driving the moveable knife 14. Therefore, the stroke, operating speed and operating pressure of the moveable knife 14 can be determined so as to be in agreement with the thickness of the piece of cloth to be cut. No excessively large forces are exerted on the components, including the knives 14 and 16.

Figure 3A:
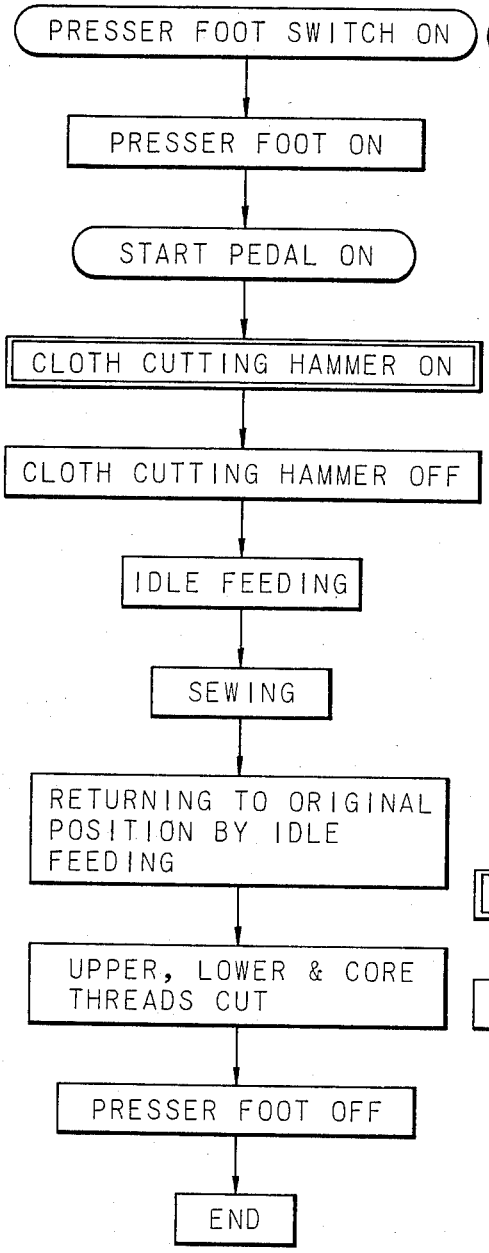
FIGS. 3*a* and 3*b* are flow charts showing the operation of the button-hole sewing machine.
Figure 3B:
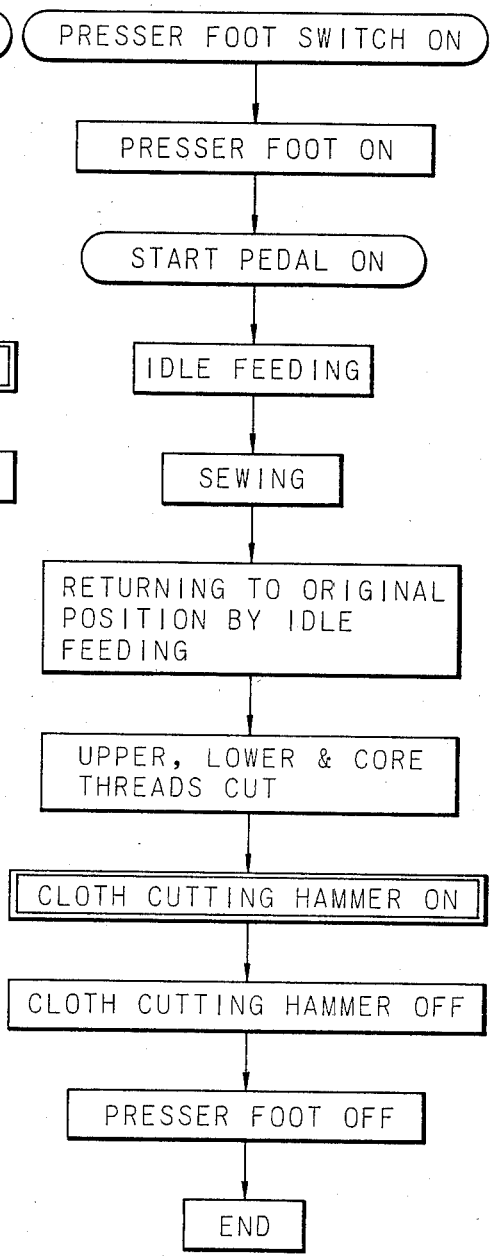

In the above-described example, the piece of cloth is cut after being sewn. A program for an operation shown in part (a) or part (b) of FIG. 3 is written in the ROM (read-only memory) of the microcomputer in the control panel 42. When the hammer lever operation selecting switch 44 is turned on, the operating sequence, except for the operation of the cloth cutting hammer lever (cloth cutting hammer - ON), is effected. When the cloth cutting operation is carried out after the sewing operation, an operating sequence as shown in part (b) of FIG. 3 will be effected. In this case when a presser foot switch (not shown) is turned on, a presser foot (not shown) on the sewing machine bed 2 is operated to retain the piece of cloth in place.

Thereafter the start pedal is operated (depressed) so as to turn on the operating switch. Idle feeding is carried out by the cloth feeding unit, and then sewing is effected according to a button hole sewing pattern. When the sewing operation is accomplished, the piece of cloth is returned to its original position and the upper and lower threads and the core thread are cut. Then the moveable knife 14 of the cloth cutting device 8 of the invention is operated to cut the piece of cloth. Thereafter, the presser foot is turned off to release the piece of cloth. Thus, the hole sewing has been accomplished.

In the case where it is necessary to perform the cloth cutting operation with the cloth cutting device 8 prior to the button hole sewing operation, the program in the control panel 42 should be changed so as to perform the operation sequence in part (a) of FIG. 3.

As is clear from the above description, in the cloth cutting device of the invention a linkage for driving the moveable knife relative to the stationary knife and an air drive unit for driving the linkage are provided so that the cloth cutting operation is carried out by the cooperation of the two knives, with the stroke, operating speed and operating pressure of the moveable knife being adjustable.

What is claimed is:

1. A cloth cutting device for a button-hole sewing machine comprising:

a stationary knife which is fixedly secured at a position where a piece of cloth is to be placed;

a moveable knife for cooperating with said stationary knife to cut said piece of cloth;

a mechanical linkage for moving said moveable knife in a cloth cutting direction; and an air drive unit for imparting a driving force to said linkage, said air drive unit including:

an air cylinder for driving said linkage;

control means for controlling the supply of air to said air cylinder;

an air supply pipe and an air exhaust pipe connected between said air cylinder and said control means; a pressure controller for controlling the pressure of air supplied to said control means; a first speed controller provided in said air supply pipe for adjusting the air supply speed and a second speed controller provided in said air exhaust pipe for adjusting the air exhaust speed.

2. A cloth cutting device for a button-hole sewing machine comprising:

a stationary knife fixedly secured to said machine at a position where a piece of cloth is to be placed;

a moveable knife moveably mounted on said machine for cooperation with said stationary knife to cut said piece of cloth, a mechanical linkage for moving said moveable knife in a cloth cutting direction and an air drive unit for imparting a moveable knife driving force to said linkage; said air drive unit comprising an air cylinder for driving said linkage, control means for controlling the supply of air to said cylinder, an air supply pipe and an air exhaust pipe connecting said control means with said air cylinder and speed control means for adjusting the rate of supplying air to said air cylinder to control the operating speed of the moveable knife.

3. A cloth cutting device as set forth in claim 2 wherein said speed control means is comprised of a first speed control valve for controlling the air supply rate in said air supply pipe and a second speed control valve controlling the air exhaust rate in said air exhaust pipe.

4. A device as set forth in claim 2 wherein said control means includes a solenoid operated valve.

5. A cloth cutting device as set forth in claim 4 further comprising a controller including a microcomputer for controlling said solenoid operated valve according to a program stored therein.

6. A cloth cutting device for a button-hole sewing maching comprising a stationary knife secured to said machine at a position where a piece of cloth is to be placed; a moveable knife moveably mounted on said machine for cooperation with said stationary knife to cut said piece of cloth; a mechanical linkage for moving said moveable knife in a cloth cutting direction; and an air drive unit for imparting a moveable driving force to said linkage; said air drive unit comprising an air cylinder for driving said linkage, control means for controlling the supply of air to said cylinder and a pressure controller adjusting the air pressure supplied to said cylinder to adjust the operating pressure of said moveable knife against said stationary knife.

* * * * *